US011002045B2

(12) United States Patent
Ramus

(10) Patent No.: US 11,002,045 B2
(45) Date of Patent: May 11, 2021

(54) DOOR BAR SECURITY SYSTEM

(71) Applicant: Andrew Gregg Ramus, Boca Raton, FL (US)

(72) Inventor: Andrew Gregg Ramus, Boca Raton, FL (US)

( * ) Notice: Subject to any disclaimer, the term of this patent is extended or adjusted under 35 U.S.C. 154(b) by 506 days.

(21) Appl. No.: 15/993,758

(22) Filed: May 31, 2018

(65) Prior Publication Data

US 2019/0048630 A1 Feb. 14, 2019

Related U.S. Application Data

(60) Provisional application No. 62/542,589, filed on Aug. 8, 2017.

(51) Int. Cl.
*E05C 19/00* (2006.01)
*E05C 19/18* (2006.01)

(52) U.S. Cl.
CPC ..... *E05C 19/003* (2013.01); *E05C 19/184* (2013.01)

(58) Field of Classification Search
CPC ..... E05C 19/003; E05C 19/184
See application file for complete search history.

(56) References Cited

U.S. PATENT DOCUMENTS

2008/0030029 A1* 2/2008 McGinnis ..... E05C 19/003 292/259 R

* cited by examiner

*Primary Examiner* — Kristina R Fulton
*Assistant Examiner* — James Edward Ignaczewski
(74) *Attorney, Agent, or Firm* — Dunlap Bennett & Ludwig, PLLC

(57) ABSTRACT

A door bar system is provided. The door bar system is adapted to mount to the periphery of the opening of a secured door to prevent break ins therethrough. The door bar system provides at least one systemic hinged bracket providing a mounting plate to connect to the periphery of the door opening, therethrough, and into the supporting wall of the door opening. Each hinged bracket has a door bar engager pivotally connected to the mounting plate for moving between a collapsed condition, further lowering its profile, and an operable condition for engaging a door bar for locking the door in a secured configuration.

9 Claims, 3 Drawing Sheets

DOOR BAR SECURITY SYSTEM

CROSS-REFERENCE TO RELATED APPLICATION

This application claims the benefit of priority of U.S. provisional application No. 62/542,589, filed 8 Aug. 2017, the contents of which are herein incorporated by reference.

BACKGROUND OF THE INVENTION

The present invention relates to devices for securing doors and, more particularly, to a door bar system adapted to mount to the periphery of the opening of a secured door to prevent break ins therethrough.

The conventional front door chain lock and deadbolt do not provide forcible entry protection. Current forcible-entry door security devices mount through the front of the door molding and through the wall to reach the wall studs, or they are unattractively and obstructively connected directly to the wall to reach the wall studs. Either way, although these current door security devices provide forcible entry protection, they require you to damage the wall or door molding.

As can be seen, there is a need for a door bar system adapted to mount to the inside of the secured door opening to prevent break ins, while preserving the aesthetics and structural integrity of the surrounding wall. The present invention system embodies at least one door bar hinge bracket mounted to the wall stud through the inner wall periphery/jamb. The door bar rests on hinge brackets, which are pivotal between an operable condition and a collapsed condition out of the way. The door bar is resistant to forcible entry break-ins engaging the hinge brackets in the secured configuration, while the door bar may be disengaged from the hinge brackets in the unsecured configuration.

SUMMARY OF THE INVENTION

In one aspect of the present invention, a security door bar system includes a door opening defined by a periphery formed into a supporting wall; at least one hinge bracket, each hinge bracket connected within the door opening to said periphery; and each hinge bracket provides a door bar engager for securely engaging a door bar.

In another aspect of the present invention, the security door bar system, includes a door opening defined by a periphery formed into a supporting wall; two hinges bracket, each hinge bracket connected within the door opening to opposing portions of said periphery; a mounting plate for connecting each hinge bracket within said door opening to opposing portions of said periphery; a door bar engager pivotally connected to each mounting plate so that the door bar engager is movable between an operable condition and a collapsed condition generally parallel with the supporting wall; and a door bar made of durable, fire-resistant material dimensioned to engage each door bar engager.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a door bar system adapted to mount to the periphery of the opening of a secured door to prevent break ins therethrough. The door bar system provides at least one systemic hinged bracket providing a mounting plate to connect to the periphery of the door opening, therethrough, and into the supporting wall of the door opening. Each hinged bracket has a door bar engager pivotally connected to the mounting plate for moving between a collapsed condition, further lowering its profile, and an operable condition for engaging a door bar for locking the door in a secured configuration.

Figure 3:
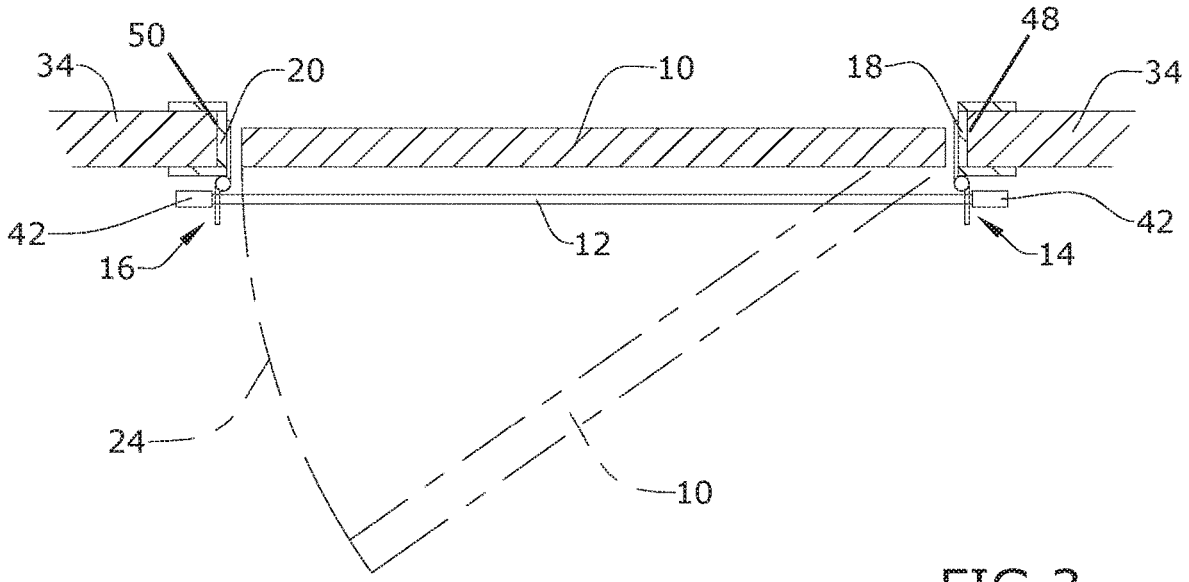
FIG. 3 is a top plan view of an exemplary embodiment of the present invention.
Figure 4:
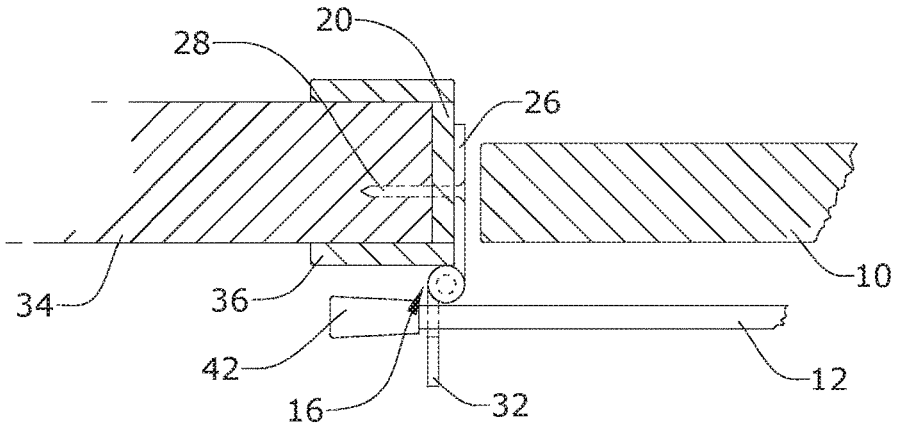
FIG. 4 is a detail top plan view of an exemplary embodiment of the present invention, demonstrating a secured configuration.
Figure 5:
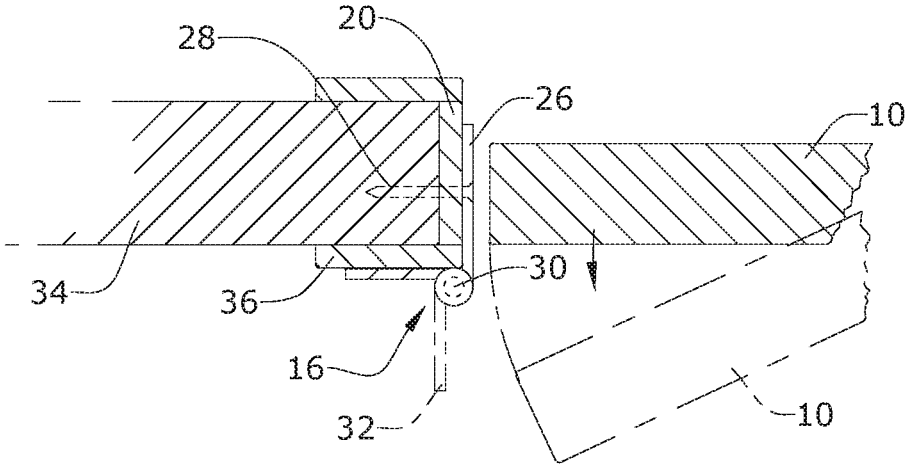
FIG. 5 is a detail top plan view of an exemplary embodiment of the present invention, demonstrating an unsecured configuration.
Figure 6:
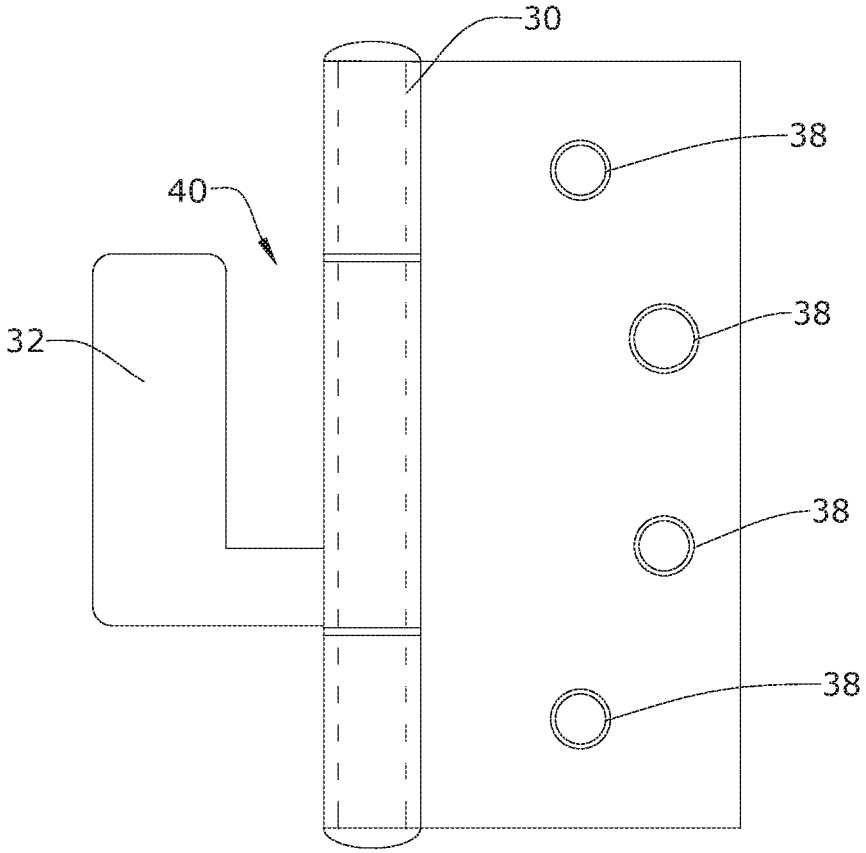
FIG. 6 is a detail side view of an exemplary embodiment of the present invention.

Referring to FIGS. 1 through 6, the present invention may include a door bar system 100 adapted to mount to the door opening periphery of a secured door 10 to prevent break ins. The door 10 may have a door knob 22 for pivoting (through a swinging motion 24) the door 10 about door hinges (not shown) between a closed and an open position. The door opening may be defined by right and left jambs 18 and 20 or opposing wall peripheries 48 and 50, respectively. The door opening is typically cut out from a wall 34 wherein the right and left jambs 18 and 20 are attached to the opposing wall peripheries 48 and 50, as illustrated in FIG. 3. Typically, the right and left jambs 18 and 20 will be finished with trim 36 along both sides of the opposing wall peripheries, as illustrated in FIG. 5.

Figure 1:
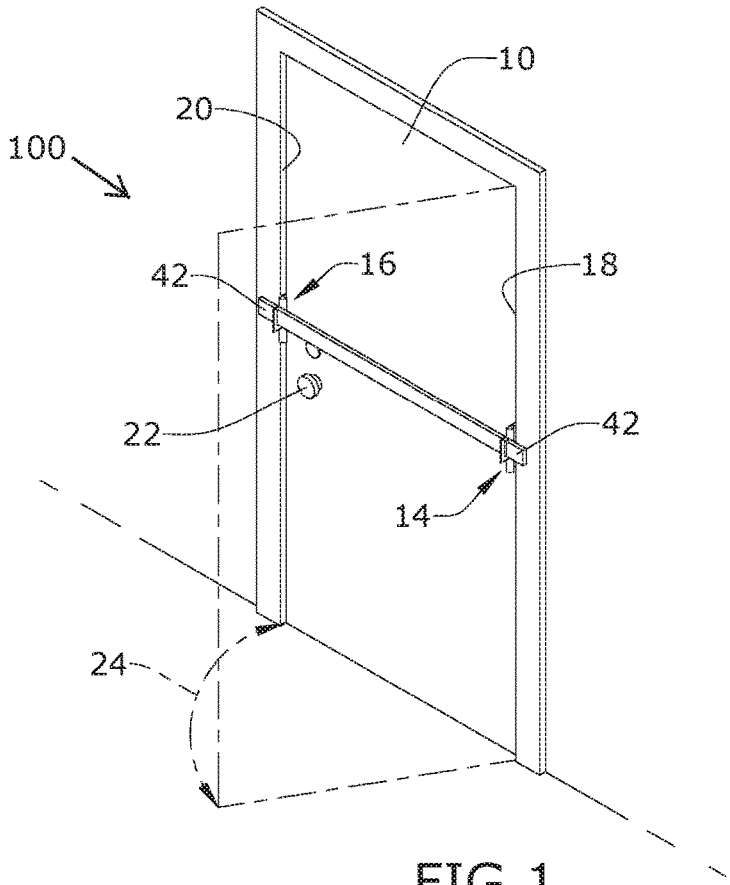
FIG. 1 is a perspective view of an exemplary embodiment of the present invention, shown in use.
Figure 2:
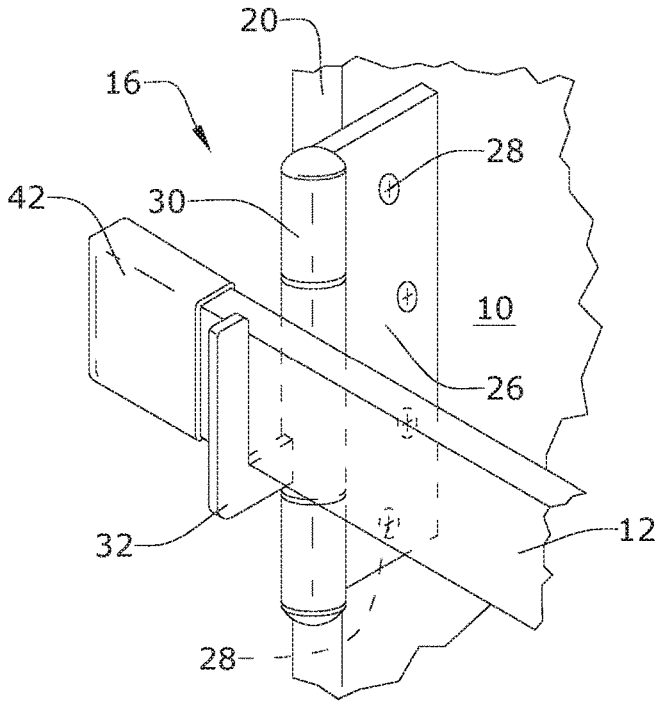
FIG. 2 is a detailed perspective view of an exemplary embodiment of the present invention.

It should be understood by those skilled in the art that the use of directional terms such as right, left, inner, and the like are used in relation to the illustrative embodiments as they are depicted in the figures, the rightward direction being directed toward the right-hand side of FIG. 1, leftward direction being directed toward the left-hand side of FIG. 1, and the inner direction being directed to the door opening.

The door bar system 100 embodies a door bar 12 made of any durable, fire-resistant material, such as solid aluminum. The door bar 12 is dimensioned to extend between a right and a left hinge bracket 14 and 16, where the right and left hinge brackets 14 and 16 are connected to the opposing right and left jambs 18 and 20, respectively. The door bar 12 may be an elongated member and have protective caps 42 on each opposing end thereof for preventing damage to the door 10, jambs 18, 20, trim 36, and/or wall 34.

Each hinge bracket 14 and 16, accordingly, provides a mounting plate 26 so that fasteners 28, such as screws, connect (through plate holes 38, for example) the hinge brackets 14 and 16 to the respective door jamb 18 and 20 and opposing wall peripheries 48 and 50. A door bar engager 32 is pivotally connected to each mounting plate 26 by way of a pivotal connection 30, such as a hinge. The door bar engager 32 provides a receiving slot or other stop 40, for example through being hook shaped. The door bar engager 32/stop 40 is movable about the pivotal connection 30 between an operable condition as illustrated in FIG. 4 and a collapsed condition as illustrated in FIG. 5. In the operable condition the door bar engager 32 is generally planar with the respective jamb 18 or 20 or wall peripheries 48/50 defining the door opening, whereby the door bar 12 may be received by the stop 20 so that the door 10 is in a secured configuration, as illustrated in FIGS. 1 through 4. In the collapsed condition, the door bar 12 is disengaged with the stop(s) 40 and the door is in an unsecured configuration, as illustrated in FIG. 5. In the collapsed condition, the door bar engager 32 is generally parallel with the wall 34.

A method of using the present invention may include the following. The door bar system 100 disclosed above may be provided. A user may install the opposing hinge brackets 14 and 16 on opposing door jambs 18 and 20 and/or wall peripheries 48/50. Then when the user desires to move the door 10 into the secured configuration, the user may move the door bar engagers 32 to the operable condition, and then make sure the door bar 12 spans between the two opposing stops 40, protecting the door 10 from forceable entry. When the user wants the door 10 to be in the unsecured configuration, the user may remove the door bar 12 and then move one or more of the door bar engagers 32 to the collapsed condition.

It should be understood, of course, that the foregoing relates to exemplary embodiments of the invention and that modifications may be made without departing from the spirit and scope of the invention as set forth in the following claims.

What is claimed is:

1. A security door bar system, comprising:

a door opening defined by a periphery formed into a supporting wall;

only a single hinge bracket on each side of the door periphery connected only to said periphery; and each hinge bracket provides a door bar engager for securely engaging a door bar.

2. The security door bar system of claim 1, wherein said periphery is covered by a door jamb.

3. The security door bar system of claim 1, wherein each hinge bracket comprises a mounting plate for connecting to said periphery.

4. The security door bar system of claim 1, wherein each door bar engager is pivotal between an operable condition and a collapsed condition generally parallel with the supporting wall.

5. The security door bar system of claim 1, further comprising a door bar made of durable, fire-resistant material dimensioned to extend beyond opposing portions of said periphery.

6. The security door bar system of claim 1, further comprising a door bar made of durable, fire-resistant material dimensioned to engage each door bar engager.

7. The security door bar system of claim 1, wherein each door bar engager provides a slot for engaging a portion of a door bar.

8. A security door bar system, comprising:

a door opening defined by a periphery formed into a supporting wall;

only a single hinge bracket on each side of the door periphery, connected only to said periphery;

a mounting plate for connecting each hinge bracket within said door periphery;

a door bar engager pivotally connected to each mounting plate so that the door bar engager is movable between an operable condition and a collapsed condition generally parallel with the supporting wall; and a door bar made of durable, fire-resistant material dimensioned to engage each door bar engager.

9. The door bar system of claim 8, wherein said periphery is covered by a door jamb.

* * * * *